US007098874B2

(12) United States Patent
Kang et al.

(10) Patent No.: US 7,098,874 B2
(45) Date of Patent: Aug. 29, 2006

(54) METHOD AND APPARATUS OF DRIVING PLASMA DISPLAY PANEL

(75) Inventors: Seong Ho Kang, Dsegu-shi (KR); Moon Shick Chung, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 462 days.

(21) Appl. No.: 10/310,994

(22) Filed: Dec. 6, 2002

(65) Prior Publication Data

US 2003/0122736 A1 Jul. 3, 2003

(30) Foreign Application Priority Data

Dec. 6, 2001 (KR) ..... 10-2001-0077110

(51) Int. Cl.
*G09G 3/28* (2006.01)

(52) U.S. Cl. ..... 345/60; 345/66; 345/68

(58) Field of Classification Search ..... 345/60–69, 345/204–215

See application file for complete search history.

(56) References Cited

U.S. PATENT DOCUMENTS 6,100,863 A * 8/2000 Zhu ..... 345/89
6,476,801 B1 * 11/2002 Nagai ..... 345/213
6,608,610 B1 * 8/2003 Nagai ..... 345/63
6,674,429 B1 * 1/2004 Correa et al. ..... 345/211
6,791,516 B1 * 9/2004 Kang ..... 345/63
2002/0084954 A1 * 7/2002 Nagai ..... 345/60
2003/0048246 A1 * 3/2003 Ham ..... 345/87

FOREIGN PATENT DOCUMENTS

JP H08063124 A * 8/1996

* cited by examiner

*Primary Examiner*—Vijay Shankar
(74) *Attorney, Agent, or Firm*—Fleshner & Kim, LLP

(57) ABSTRACT

A method and apparatus are provided for driving a plasma display panel. This may include detecting an average picture level of a picture to be transmitted from an input device to a mapping device and to be displayed on the plasma display panel. This may also include mapping a number and an arrangement of sub-fields with respect to each pixel data based on the detected average picture level and determining a total discharge frequency and a discharge frequency by sub-fields based on the detected average picture level.

11 Claims, 5 Drawing Sheets

FIG. 2

APL DATA

| | GAIN VALUE |
|---|---|
| 00000 | 180 |
| 00001 | 188 |
| 00010 | 190 |
| ⋮ | ⋮ |
| 11110 | 250 |
| 11111 | 255 |

FIG.3

SUBSTITUTED APL DATA

| PIXEL DATA | | SF MAPPING DATA |
|---|---|---|
| 000000000 | 00000 | 111110000000 |
| | 00001 | 111111111000 |
| | 00010 | 111011101000 |
| | ⋮ | ⋮ |
| | 11110 | 111111011010 |
| | 11111 | 111011111011 |
| ⋮ | | |
| 111111111 | 00000 | 111010001000 |
| | 00001 | 111000111111 |
| | 00010 | 110011101110 |
| | ⋮ | ⋮ |
| | 11110 | 100011011011 |
| | 11111 | 110011001111 |

METHOD AND APPARATUS OF DRIVING PLASMA DISPLAY PANEL

BACKGROUND OF THE INVENTION

1. Field of the Invention

This invention relates to a plasma display panel, and more particularly to a method and an apparatus of driving a plasma display panel that is adaptive for not only consuming uniform power, but also making pictures switched continuously.

2. Description of the Related Art

Generally, a PDP driving apparatus displays a picture on the PDP by controlling the number and an arrangement of sub-fields. As the number of the sub-fields decreases, a sustain period, i.e., the number of sustains, increases to display a bright picture, i.e., a picture with high brightness, on the PDP. However, there is contour noise seriously generated in a moving picture that is displayed by a method of a few sub-fields, so as to deteriorate a picture quality. On the other hand, if the number of the sub-fields increases, the contour noise appearing in the moving picture is reduced remarkably to improve the picture quality, but the brightness of the picture displayed on the PDP decreases. This is because the sustain period, i.e., the number of sustains, is reduced due to the increase of a reset period and an address period as much as the increase of the number of the sub-fields.

Further, in the PDP driving apparatus, power dissipated for a discharge increases as a screen area of the PDP increases. Due to this, it might be possible that the PDP driving apparatus dissipate more than a threshold power of its own. In order to solve this problem, there has been a method that an area is divided into three or four stages through trial and error to reduce the number of the sustains appropriately, so that a power consumption is made to be within a range of a threshold or less. However, in such a area division method, the number of the sustains is not continuously changed like a staircase. That is, the number of the sustains is discontinuously changed in the area division method. There appears a noise in a form of flicker on the screen at the moment when the number of the sustains is changed discontinuously.

As a result, in the conventional PDP driving apparatus, it is inevitable that the power consumption may not only swerve from the threshold power range, but there may be also a discontinuous switching of the picture caused by the discontinuity of the number of the sustains.

SUMMARY OF THE INVENTION

Accordingly, it is an object of the present invention to provide a method and an apparatus of driving a plasma display panel that is adaptive for not only consuming uniform power, but also making pictures switched continuously.

In order to achieve these and other objects of the invention, a method of driving a plasma panel display according to an aspect of the present invention includes steps of detecting an average picture level of a picture to be transmitted from an input means to a mapping means and to be displayed on the plasma display panel; mapping the number and an arrangement of sub-fields with respect to each pixel data on the basis of the average picture level; and determining a total discharge frequency and a discharge frequency by sub-fields on the basis of the APL.

In the method, the mapping step includes a step of controlling a gain of the pixel data on the basis of the average picture level.

In the method, the mapping step includes a step of diffusing an error of the pixel data.

A driving apparatus of a plasma display panel according to another aspect of the present invention includes an input means for inputting a pixel data of a picture to be displayed on the plasma display panel; a detecting means for detecting an average picture level from the pixel data of the input means; a mapping means for mapping the number and an arrangement of sub-fields with respect to the pixel data from the input means on the basis of the average picture level; and a determining means for determining a total discharge frequency and a discharge frequency by sub-fields on the basis of the average picture level.

The driving apparatus further includes a means for controlling a gain of the pixel data to be transmitted from the input means to the mapping means on the basis of the average picture level.

The driving apparatus further includes a means for diffusing an error of the pixel data from the input means to the mapping means.

BRIEF DESCRIPTION OF THE DRAWINGS

These and other objects of the invention will be apparent from the following detailed description of the embodiments of the present invention with reference to the accompanying drawings, in which:

FIG. 2 is a table showing output data with respect to input data of a gain controller shown in FIG. 1;

FIG. 3 is a sub-field mapping table included in a sub-field mapping unit shown in FIG. 1;

DETAILED DESCRIPTION OF THE PREFERRED EMBODIMENT

Reference will now be made in detail to the preferred embodiments of the present invention, examples of which are illustrated in the accompanying drawings.

Figure 1:
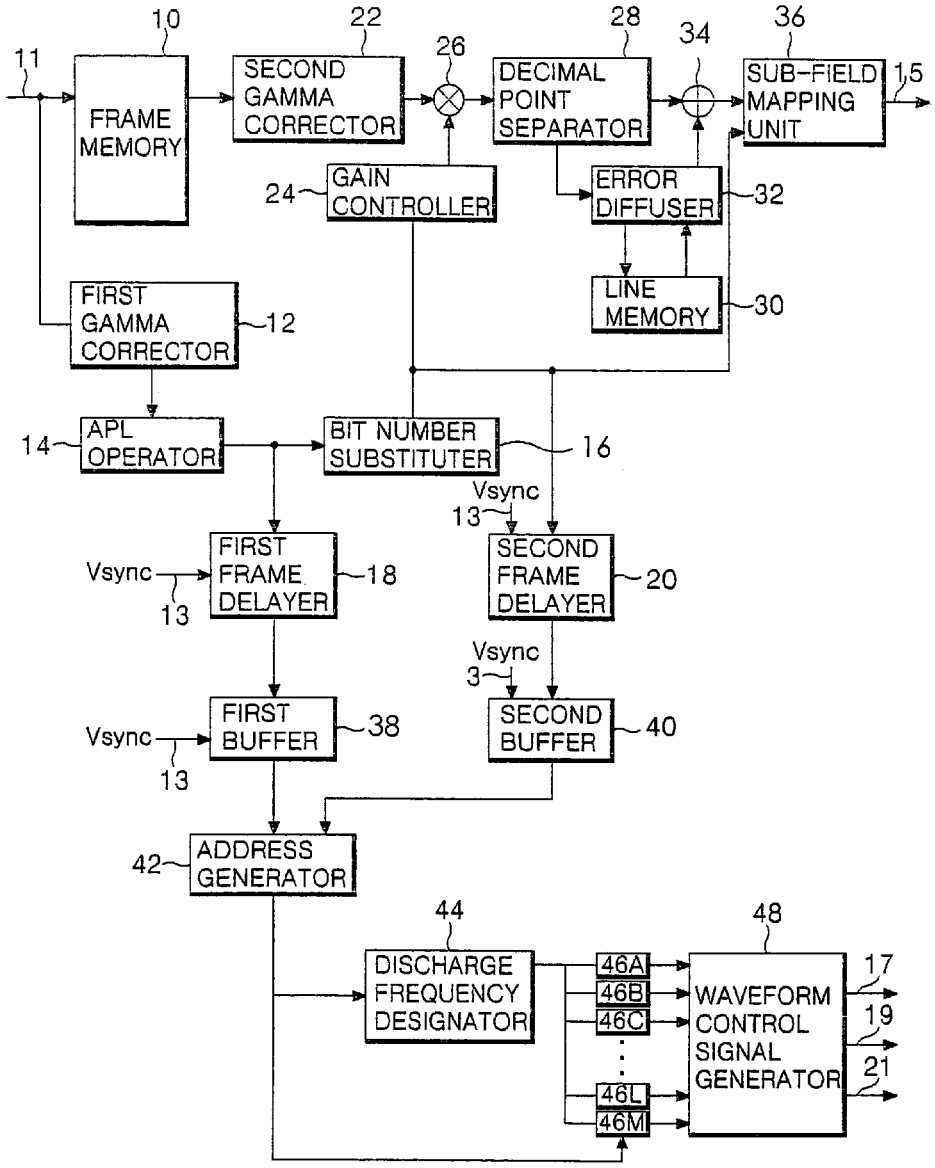
FIG. 1 is a block diagram schematically representing a plasma display panel driving apparatus according to an embodiment of the present invention.

FIG. 1 schematically illustrates a plasma display panel driving apparatus according to an embodiment of the present invention.

Referring to FIG. 1, the PDP driving apparatus includes a frame memory 10 and a first gamma corrector 12 connected to an input bus line 11 commonly.

The frame memory 10 delays red R, green G and blue B data sequentially inputted from the input bus line 11 for a period corresponding to one frame, and then sequentially outputs the delayed R, G and B. Each of the R, G and B data inputted into the frame memory 10 is composed of 8 bits.

The first gamma corrector 12 corrects gamma errors included in each of the R, G and B data sequentially inputted from the input bus line 11 and makes the R, G and B data have linearity instead of non-linearity. In order to correct such gamma errors, the first gamma corrector 12 includes a gamma correction look-up table where logical values with linearity corresponds to logical values with non-linearity respectively. Each of R, G and B data corrected by the first gamma corrector 12 has 8 bits in the same way as the R, G and B of the input bus line 11. The corrected R, G and B data are sequentially applied frota the first gamma corrector 12 to an APL operator 14.

The APL operator 14 calculates an average level value of a picture which is be displayed on a panel (not shown), every frame. To this end, the APL operator 14 accumulates the R, G and B data of one frame portion sequentially inputted from the first gamma corrector 12, and then divides the accumulated data by the number of pixels of the panel. The APL data from the AFL operator 14 consist of 8 bits in the same way as R, G and B data of the input bus line 11. The APL data are commonly applied to a bit number substituter 16 and a first frame delayer 18.

The bit number substituter 16 converts APL data of 8 bits into APL data of 5 bits. To this end, the bit number substituter 16 may include an operator that divides the APL data by a substitution variable with a designated value, e.g., '8', and outputs their quotient as a substituted APL data. In another way, the bit number substituter 16 may include a bit substitution look-up table in which the logical values, i.e., gray level value, of the substituted APL data corresponding to '1', for each of logical values, i.e., gray level values, of a designated number of the APL data are recorded. In the bit substitution look-up table, it is possible to control the number of logical values of the APL data corresponding to the logical values of the substituted APL data respectively.

In the event that the number of the logical values of the APL data corresponding to each of the logical values of the substituted APL data is made appropriately different, picture quality and brightness of a picture displayed on the PDP are improved. In this point of view, it is more desirable to have the bit number substituter 16 include the bit substitution look-up table than the operator. Also, the substituted APL data outputted from the bit number substituter 16 may have other number of bits than 5 bits. And, it is possible to set the number of bits of the APL inputted to the bit number substituter 16 differently. Furthermore, the bit number substituter 16 applies the substituted APL data to a second frame delayer 20.

A first frame delayer 18 delays the APL data of 8 bits from the APL operator 14 for one frame period under the control of a vertical synchronization signal Vsync from a synchronizing signal line 13. Also, the first frame delayer 18 outputs the delayed APL data. To this end, the first frame delayer 18 includes a flip-flop latching the APL data from the APL operator 14 to an output in any one of a falling edge and a rising edge of the vertical synchronization signal.

A second frame delayer 20 delays the substituted APL data of 5 bits from the bit number substituter 16 for one frame period under the control of a vertical synchronization signal Vsync from a synchronizing signal line 13. Also, the second frame delayer 20 outputs the delayed, substituted APL data. To this end, the second frame delayer 20 includes a flip-flop latching the substituted APL data from the bit number substituter 16 to an output in any one of a falling edge and a rising edge of the vertical synchronization signal.

The PDP driving apparatus includes a second gamma corrector 22 connected to the frame memory 10, and a gain controller 24 connected to the bit number substituter 16. The second gamma corrector 22 corrects gamma errors included in each of the R, G and B data sequentially inputted from the frame memory 10 to make the R, G and B data have linearity instead of non-linearity. In order to correct such gamma error, the second gamma corrector 22 includes a gamma correction look-up table where logical values with linearity correspond to logical values with non-linearity respectively. Each of R, G and B data corrected by the second gamma corrector 22 includes an integer part of 8 bits and a fractional part of 4 bits differently from the R, G and B data of the input bus line 11. The second corrector 22 applies 12 bit data which is gamma-corrected to a multiplier 26.

On the other hand, the gain controller 24 applies any one of 32 gain values which are different in accordance with the logical values of the substituted APL data of 5 bits from the bit number substituter 16, to the multiplier 26. In order to output the gain values in accordance with the logical values of the substituted APL data, the gain controller 24 includes a look-up table storing 9 bit gain values corresponding to the logical values of the substituted APL data respectively, or a register selectively outputting 32 gain values different from one another in accordance with the substituted APL data. In the look-up table or the register included in the gain controller 24, as shown in FIG. 2, there are 32 gain values such as '180', '185', '190', . . . , '250' and '255' recorded corresponding to the logical values '00000' to '11111' of the substituted APL data. Even though the maximum gain value recorded in the look-up table and the register is '180' and differences between these gain values are 5 each, the maximum gain value and the difference between the gain values can be changed. The gain value applied from the gain controller 24 to the multiplier 26 is composed of 9 bits. The gain value may have more or less number of bits other than 9 bits.

The multiplier 26 multiplies the gamma corrected 12 bit data from the second gamma corrector 22 by the gain value from the gain controller 24 and applies the R, G and B data with their gain adjusted to a decimal point separator 28. Each of the R, G and B data outputted from the multiplier 26 includes an integer part of 9 bits and a fractional part of 5 bits. Further, each of the R, G and B data outputted from the multiplier 26 can have their total bit number, the bit number of the integer part and the bit number of the fractional part set differently.

The decimal point separator 28 divides a 14 bit data from the multiplier 26 into a 9 bit integer part data and a 5 bit fractional part data, and the integer part data is applied to the an adder 34 and the fractional part data is applied to an error diffuser 32. To this end, the decimal point separator 28 includes wires, i.e., upper 9 bit lines connected to the adder 34 and lower 5 bit lines connected to the error diffuser 32. In another way, the decimal point separator 28 may have a 14 bit register, upper 9 bit output terminals of which are connected to the adder 34 and the lower 5 bit output terminals are connected to the error diffuser 32.

The error diffuser 32 stores the fractional part data sequentially inputted from the decimal point separator 28 to a line memory 30. Also, the error diffuser 32 does error diffusion to a carry signal which is generated when operating the fractional part data of a presently inputted pixel and the fractional part data of the pixels positioned around the present pixel in accordance with designated rules, and applies the error-diffused carry signal to the adder 34.

The adder 34 applies the 9 bit integer part of the R, G and B data from the decimal point separator 28 and the R, G and B data of 9 bits that are primarily error-diffused by being added to the carry signal from the error diffuser 32, to the sub-field mapping unit 36.

The sub-field mapping unit 36 maps sub-fields for each R, G and B data so that the number and arrangement of the sub-fields to be discharged are changing in accordance with frames, i.e., according to the brightness of a picture, even though the logical value of each R, G and B data of 9 bits is the same regardless of the frames. More particularly, the sub-field mapping unit 36 is provided with a plurality of sub-field maps, e.g., 32 kinds of sub-field maps, where the number and arrangement of the sub-fields to be discharged are different in regard to each gray level value of the R, G and B data, and then selects any one of a plurality of sub-field maps, e.g., 32 kinds of sub-field maps, in accordance with the logical value of the substituted APL data of a specified bit number, e.g., 5 bits, from the bit number substituter 16 to be applied to an address driver circuit (not shown) of the plasma display panel. Also, in the sub-field mapping unit 36, the maximum number of the sub-fields which can be discharged in regard to one gray level value of the R, G and B data is set to be larger than the bit number of the data. For example, the number of sub-fields are set to be 12 which is larger by 3 than the bit number of 9 bit color data. Accordingly, the 9 bit color data, i.e., R, G or B data, outputted from the adder 34 are mapped to any one of the sub-field maps of 32 kinds, as shown in FIG. 3, in accordance with the logical value of the substituted APL data of 5 bits generated at the bit number substituter 16, to be converted into 12 bit color data.

Further, the PDP driving apparatus includes a first buffer 38 and a second buffer 40 connected to the first and second delayer 18 and 20 respectively. The first buffer 38 responds to the vertical synchronization signal Vsync from the synchronizing signal line 13 to transmit the APL data from the first frame delayer 18 to an address generator 42. To this end, the first buffer 38 includes a latch circuit latching the 8 bit APL data from the first frame delayer 18 from any one of a rising edge and a falling edge of the vertical synchronization signal Vsync to the address generator 42.

The second buffer 40 responds to the vertical synchronization signal Vsync from the synchronizing signal line 13 to transmit the substituted APL data from the second frame delayer 20 to an address generator 42. To this end, the second buffer 40 includes a latch circuit latching the substituted 5 bit APL data from the second frame delayer 20 from any one of a rising edge and a falling edge of the vertical synchronization signal Vsync to the address generator 42.

The address generator 42 loads the 8 bit APL data and the substituted 5 bit APL data from the first and second buffer 38 and 40 to upper 13 bits and then generates an address signal of 17 bits where their lower 4 bits sequentially increase by '1', to apply to a discharge frequency designator 44. The period when the logical value of the address signal generated at the address generator 42 are increasing is changing in accordance with the logical value of the APL data so that the total number of the sustain pulses, i.e., total discharge frequency, generated during the frame period is made to get larger or fewer.

The discharge frequency designator 44 reads a discharge frequency to be generated during one sub-field period, which is recorded at a storing position corresponding to the logical value of the 17 bit address signal from the address generator 42 and applies the read discharge frequency to a first to a thirteenth register 46A to 46M. To this end, the discharge frequency designator 44 includes a memory storing a discharge frequency set where a discharge frequency value is a designated number, e.g., 7, or more and less than the maximum number of the sub-fields, e.g., 12, corresponding to the logical values of the upper 13 bits among 17 bits of the address signal. The discharge frequency values included in the discharge frequency set are set to increase by at least a number bigger than 1 randomly as the logical value of the lower 4 bit address signal increases among the 17 bit address signal. The number of the discharge frequency values included in the discharge frequency set is close to the minimum number as the logical value of the APL gets low. Whereas, if the logical value of the APL data is the threshold or more, the number of the discharge frequency values is the highest number of the discharge frequency value.

The first to thirteenth registers 46A to 46M commonly receive the lower 4 bits of the address signal among the 17 bits of the address signal generated at the address generator 42. The first to thirteenth registers 46A to 46M are sequentially driven in accordance with the logical value of the lower 4 bit address signal, latch the discharge frequency from the discharge frequency designator 44 and then apply the latched discharge frequency to a waveform control signal generator 48.

The waveform control signal generator 48 applies sustain pulses corresponding to the discharge frequency sequentially inputted from the first to thirteenth registers 46A to 46M to a scan driver circuit (not shown) and a common driver circuit (not shown) during one sub-field period. Besides, the waveform control signal generator 48 applies various pulses necessary for driving the panel, to an address driver circuit, a scan driver circuit and a common driver circuit.

In this way, the PDP driving apparatus first calculates the APL value of an input picture. Subsequently, the PDP apparatus selects any one of a gain value of a designated kinds, i.e., 32 kinds, most suitable for the input picture and the number and arrangement of the sub-fields on the basis of the calculated APL value, and then makes the pixel data, i.e., R, G and B data, diffused in use of the selected gain value and the number and arrangement of the sub-fields. Together with this, the PDP driving apparatus generates sustain pulses that control the discharge frequency during each sub-field period in accordance with the number of the sub-fields and the total discharge frequency of the frame period on the basis of the APL value, together with various timing control signals. The PDP driving apparatus applies the diffused pixel data and the timing control signals including the sustain pulses with their numbered controlled, to the address driver circuit, the scan driver circuit and a common driver circuit.

As a result, the following problems opposing to each other can be solved. There is a problem of a picture displayed on the panel when the sustain frequency is made to increase by applying a few sub-fields. There is a problem of a picture displayed on the panel when the sustain frequency is made to increase by applying many sub-fields. To be more particular, in the event that a dark picture, i.e., a picture of a low APL, with which brightness appears to be the most major problem is displayed, the panel is made to be driven by reducing the number of sub-fields to make the total sustain frequency have the maximum value, thereby making peak brightness emphasized. Accordingly, the picture quality of the dark picture displayed on the panel is improved. Differently from this, in the event that a bright picture, i.e., a picture of a high APL, with which pseudo contour noise and power consumption appear to be the more serious problem than brightness is displayed, the panel is made to be driven by increasing the number of sub-fields to make the sustain frequency reduced for display the upper bit data, i.e., the upper bit data diffused or dispersed by the increased sub-field, thereby making the occurrence of the pseudo contour noise minimized. Accordingly, the picture quality of the bright picture displayed on the panel is improved.

Figure 4:
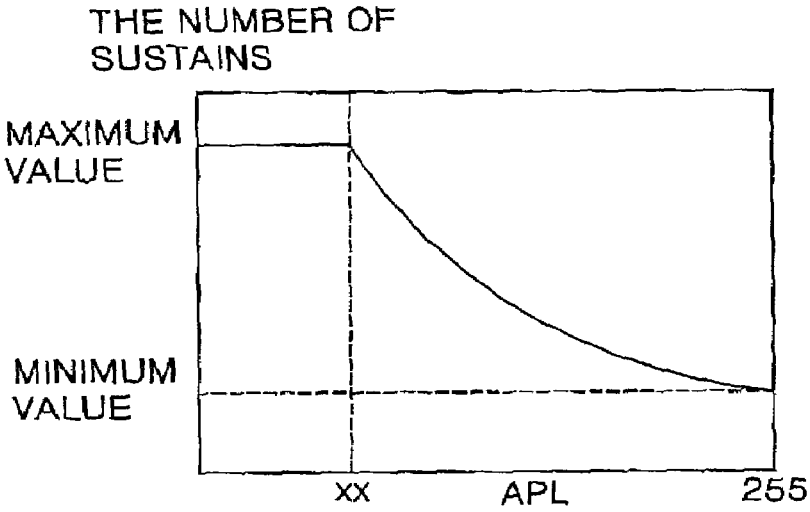
FIG. 4 is a graph representing a change of the number of sustain pulses in accordance with an APL.

In the sub-field mapping, the total sustain frequency may be determined by a relation of the APL value and the number of sustain pulses, as shown in FIG. 4. Referring to FIG. 4, a section up to a level 'XX' emphasizes a peak brightness by sustaining the number of sustains as maximal as possible in their timing. And in a section from the level 'XX' to a level 255, a screen is brightened and the number of sustains is made to decrease, so that total power supply always sustains at less than a designated value, maximum permissible power supply.

Figure 5:
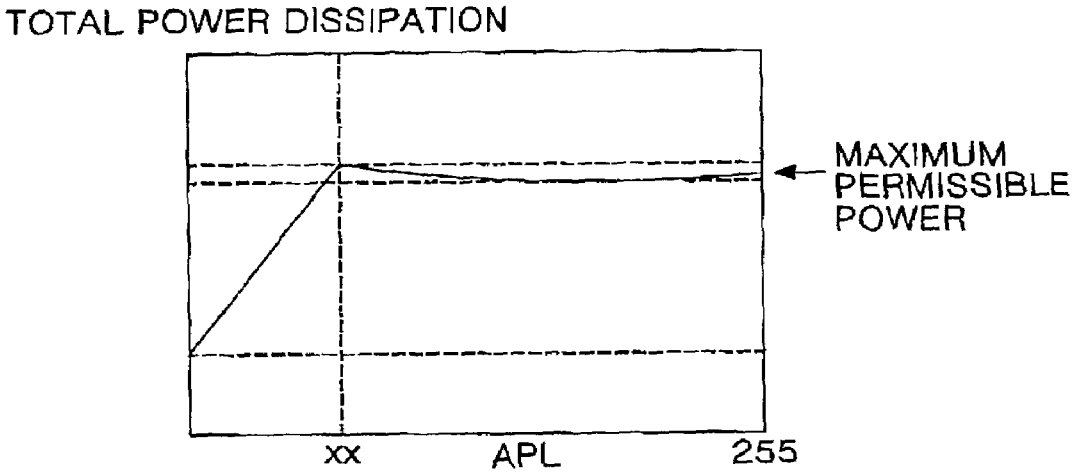
FIG. 5 is a graph representing a change of a total power dissipation in accordance with an APL.

FIG. 5 represents that the total dissipated power is kept at lower than the maximum permissible power by the fact that the number of sustains is controlled. In FIG. 5, because pixels to be turned on, i.e., to be discharged, increase until the APL reaches the level 'XX', the total power dissipation increases linearly. In the section where the value of the APL is between 'XX' and 255, the total power dissipation has an almost uniform value. Also, the power dissipated in the PDP can be divided into a reactive power dissipation consumed while a panel capacitor is charged and discharged and a discharge power dissipation consumed by a discharge which makes light radiate. Firstly, the reactive power dissipation ($P_{reactive}$) consumed by the fact that the panel capacitor charges and discharges a sustaining voltage Vs is expressed as the following Formula 1.

$$P_{reative} \cong f \times Cp \times Vs^2 \quad \text{[FORMULA 1]}$$

In Formula 1, 'f' is the frequency of sustains, i.e., the number of times, 'Cp' is the capacitance of a panel capacitor, and 'Vs' is a sustain voltage. Because the capacitance of the panel capacitor Cp and the sustain voltage Vs are uniform, the reactive power dissipation $P_{reactive}$ changes in accordance with the frequency of the sustains as in Formula 2.

$$P_{reative} \propto \text{The number of Sustains} \quad \text{[FORMULA 2]}$$

When Formula 2 is rearranged, $P_{reactive}$ is calculated by Formula 3.

$$P_{reative} = \alpha \times \text{The number of Sustains} \quad \text{[FORMULA 3]}$$

On the other hand, the discharge power dissipation $P_{discharge}$ approximates the product of the APL and the sustain frequency as in Formula 4.

$$P_{reative} \propto V_{APL} \times \text{The number of Sustains} \quad \text{[FORMULA 4]}$$

APL is average picture level in Formula 4. Also, the discharge power dissipation $P_{discharge}$ is proportional to the number of pixels discharged, so it can be calculated by Formula 5.

$$P_{reative} \propto \beta \times APL \times \text{The number of Sustains} \quad \text{[FORMULA 5]}$$

The total power dissipation is the sum of the reactive power dissipation $P_{reactive}$ and the discharge power dissipation $P_{discharge}$ calculated by Formula 3 and 5, so the total power dissipation $P_{total}$ is as follows.

$$P_{TOTAL} = [\alpha \times \text{The number of Sustains}] \times [\beta \times V_{APL} \times \text{The number of Sustains}] \quad \text{[FORMULA 6]}$$

'α' in Formula 3 and 6 is calculated by substituting the number of sustain pulses and the reactive power dissipation measured into Formula 3 after measuring the reactive power dissipation when an arbitrary number of sustain pulses are applied in a black screen. Further, 'β' is calculated by substituting the maximum permissible power, i.e., 700 W, in a specification, e.g., the standard of an article, as the total power dissipation into Formula 6. It is possible because the value of 'α' is calculated from Formula 3. However, 'β' can only be calculated in a section, i.e., XX≦APL≦255, where the APL has a value between 'XX' to '255'. This is because the number of sustain pulses has the maximum value permitted by timing in a section between '0' to 'XX'.

Accordingly, the total power dissipation $P_{total}$ in Formula 6 uniformly remains the value of the maximum permissible power in the specification in the event that the APL is between 'XX' and '255', and because 'α' and 'β' are calculated by the above way, it is possible to calculate the total sustain frequency in accordance with the APL. The total sustain frequency calculated in this way shows a characteristic of being inversely proportional to the APL, as in a curve A of FIG. 3.

Figure 6:
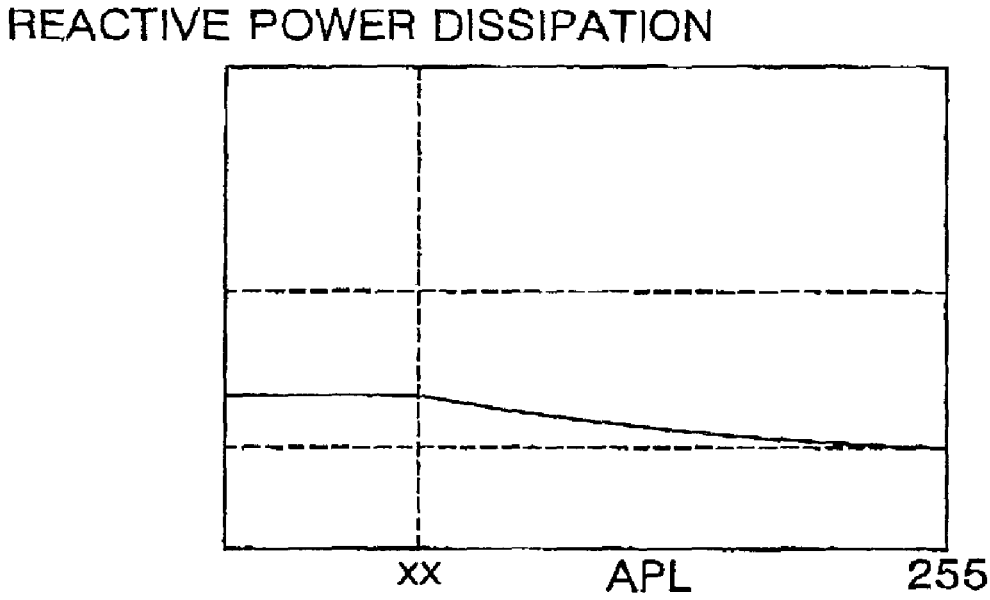
FIG. 6 is a graph representing a change of a reactive power dissipation in accordance with an APL.
Figure 7:
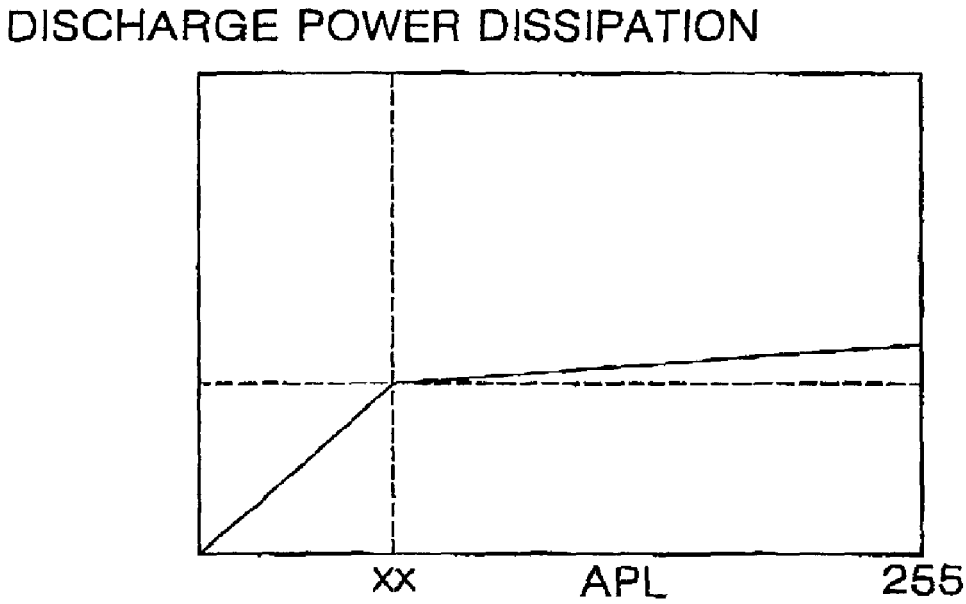
FIG. 7 is a graph representing a change of a discharge power dissipation in accordance with an APL.

To be more particular to this, if the APL is in the section between '0' and 'XX', a peak brightness is emphasized by driving the panel with the maximal sustain frequency within the range where the timing is possible in driving panel. In other words, as the APL increases from 0 to 'XX', the reactive power dissipation $P_{reactive}$ remains uniformly as shown in FIG. 6, whereas the discharge power dissipation $P_{discharge}$ increases linearly as in FIG. 7. Differently from this, in the event that the APL is in the section between 'XX and 255, the panel is driven with the total sustain frequency in inverse proportion to the APL. Accordingly, the reactive power dissipation $P_{reactive}$, as shown in FIG. 6, slowly decreases, whereas the discharge power dissipation $P_{discharge}$, as in FIG. 7, slowly increases. As a result, the total power dissipation $P_{total}$ remains uniformly, not to exceed the maximum permissible power.

The reason why it is necessary to have 32 kinds of sub-field mapping table is to solve two contrary problems that are a problem of a picture displayed on the panel when the sustain frequency is increased by applying a few sub-fields and a problem of a picture displayed on the panel when the sustain frequency is decreased by applying many sub-fields. More particularly, in the event that a dark picture is displayed, herein brightness is the most serious problem, the number of sub-fields are reduced to make the panel driven for the total sustain frequency to have the maximum value, so that the peak brightness is emphasized. As a result, the picture quality of the dark picture displayed on the panel is improved. Differently from this, in the event that a bright picture, i.e., a picture of a high APL, is displayed, herein the problem of a pseudo contour noise and a power dissipation are more serious than the brightness, the number of the sub-fields is increased for the sustain frequency for displaying upper bit data to be reduced to drive the panel, i.e., for the upper bit data to be diffused or dispersed by the increased sub-fields, so that the occurrence of the pseudo contour noise is minimized. As a result, the picture quality of the bright picture displayed on the panel is improved.

As described above, in the event that the dark picture, i.e., the picture of the low APL, is displayed, the driving method and apparatus of the plasma display panel according to the present invention drives the panel for the total sustain frequency to have the maximum value by reducing the number of sub-fields, thereby emphasizing the peak brightness and sustaining the reactive power dissipation uniformly at the same time. Also, in the event that the bright picture, i.e., the picture of high APL, is displayed, the driving method and apparatus of the plasma display panel according to the present invention drives the panel for the sustain frequency for displaying the upper bit data to be reduced by increasing the number of sub-fields, i.e., for the upper bit data to be diffused or dispersed by the increased sub-fields, thereby minimizing the occurrence of the pseudo contour noise and restraining the discharge power dissipation to increase as much as the reactive power dissipation decrease. As a result, the driving method and apparatus of the plasma display panel according to the present invention make it possible to always dissipate uniform power and to continuously switch the pictures.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus of the plasma display panel, comprising:

an input means for inputting a pixel data of a picture to be displayed on the plasma display panel;

a detecting means for detecting an average picture level from the pixel data of the input means;

a mapping means for mapping a number and an arrangement of sub-fields with respect to the pixel data from the input means based on the detected average picture level, the mapping means including means for controlling a gain of the pixel data to be transmitted from the input means to the mapping means based on the detected average picture level, and the mapping means selects one of a plurality of sub-field maps based on the detected average picture level; and a determining means for determining a total discharge frequency and a discharge frequency by sub-fields based on the detected average picture level.

2. The driving apparatus according to claim 1, wherein the mapping means further includes:

a means for diffusing an error of the pixel data from the input means to the mapping means.

3. The driving apparatus according to claim 1, further comprising a driver to apply sustain pulses corresponding to the determined discharge frequency.

4. The driving apparatus according to claim 1, wherein the mapping means sets a number of sub-fields to be discharged to a value greater than a bit number of the input pixel data.

5. A method of driving a plasma display panel, comprising steps of:

detecting an average picture level of a picture to be transmitted from an input means to a mapping means and to be displayed on the plasma display panel;

mapping a number and an arrangement of sub-fields with respect to each pixel data based on the detected average picture level, wherein the mapping includes controlling a gain of the pixel data based on the detected average picture level, and the mapping the number and the arrangement of sub-fields further includes selecting one of a plurality of sub-field maps based on the detected average picture level; and determining a total discharge frequency and a discharge frequency by sub-fields based on the detected average picture level.

6. The method according to claim 5, wherein the mapping includes diffusing an error of the pixel data.

7. The method according to claim 5, further comprising applying sustain pulses corresponding to the determined discharge frequency.

8. The method according to claim 5, wherein mapping the number and the arrangement of sub-fields includes setting a number of sub-fields to be discharged to a value greater than a bit number of input pixel data.

9. A plasma display panel comprising:

a detecting device to detect an average picture level of input pixel data;

a mapping device to map a number and an arrangement of sub-fields with respect to the input pixel data based on the detected average picture level, the mapping device to select one of a plurality of sub-field maps based on the detected average picture level;

a determining device to determine a total discharge frequency and a discharge frequency by sub-fields based on the detected average picture level; and a gain control device to control a gain of the input pixel data to be transmitted to the mapping device based on the detected average picture level.

10. The plasma display panel according to claim 9, further comprising a driver to apply sustain pulses corresponding to the determined discharge frequency.

11. The plasma display panel according to claim 9, wherein the mapping device sets a number of sub-fields to be discharged to a value greater than a bit number of the input pixel data.

* * * * *